United States Patent [19]

Sullivan

[11] 4,191,199

[45] Mar. 4, 1980

[54] APPARATUS AND PROCESS FOR RECLAIMING TOBACCO

[75] Inventor: James W. Sullivan, Glendale, Ky.

[73] Assignee: Brown & Williamson Tobacco Corporation, Louisville, Ky.

[21] Appl. No.: 892,450

[22] Filed: Apr. 3, 1978

[51] Int. Cl.[2] ..... A24C 5/36

[52] U.S. Cl. ..... 131/96

[58] Field of Search ..... 131/96, 20 R, 109 B, 131/109 AB

[56] References Cited

U.S. PATENT DOCUMENTS 2,693,808 11/1954 Kochalski et al. ..... 131/96

FOREIGN PATENT DOCUMENTS 242933 7/1960 Australia ..... 131/96

764741 8/1967 Canada ..... 131/96

894226 10/1953 Fed. Rep. of Germany ..... 131/96

*Primary Examiner*—Stephen C. Pellegrino

*Attorney, Agent, or Firm*—Charles G. Lamb; William J. Mason

[57] ABSTRACT

Apparatus and a process for reclaiming tobacco from rejected cigarettes is described in which cigarettes are first treated with hot water to saturate the paper wrapper and soften the glue holding together the edges of the cigarette wrapper. Saturation of the paper wrapper is followed by impacting the moistened cigarettes with steam. At sufficiently high temperatures, this will open the glue seam adjacent to the tobacco bearing section of the cigarette. At lower temperatures, the tobacco rod is expelled through the open end or ends of the cigarettes. The tobacco is thereafter dried and separated from the remainder of the cigarette material. The advantage of the process of the invention resides in its capacity to separate and reclaim the tobacco with minimal reduction of particle sizes. Long strands of tobacco are reclaimed intact. In addition, if the rejected cigarette includes a filter component, the filter structure may be separated intact from the remainder of the cigarette.

18 Claims, 3 Drawing Figures

APPARATUS AND PROCESS FOR RECLAIMING TOBACCO

BACKGROUND OF THE INVENTION

1. Field of the Invention

The invention relates to method and apparatus for reclaiming tobacco from reject cigarettes.

2. Brief Description of the Prior Art

In the manufacture of cigarettes it is the usual practice to reclaim tobacco from cigarettes failing to meet quality control standards. Conventionally, reclaiming has been effected by longitudinally slitting the cigarette paper enclosing the tobacco. When reclaiming tobacco from filter cigarettes, filters are removed prior to slitting. Disclosures of the prior art methods may be found, for example, in U.S. Pat. Nos. 1,956,925 and 3,224,451.

U.S. Pat. No. 3,577,999 describes an alternative prior art technique in which reject cigarettes pass through a mechanical beater. In this device, the tobacco columns are passed through a zone where they are struck by paddles which expel the tobacco from the ends of the paper tube.

Another prior art technique is described in Canadian Pat. No. 764,741. This patent teaches one to soften the glue seam with water and steam and then to open the seam by physical engagement such as with rollers, to remove the tobacco. The water-treated cigarettes may also be placed on a vibrating screen to separate the tobacco with hot air blown through the screen to dry the tobacco as it is being separated from the paper.

In German Pat. No. 894,226 non-filter cigarettes are moistened along the glue seam and then conveyed through a steam filled chamber, apparently at atmospheric pressures, to apparently permeate the paper and/or cigarette with water vapor. The treated cigarette is then thrown against a vibrating plate, preferably heated, to break open the cigarette wrapper and release the tobacco. This method was apparently directed toward cigarettes containing tobacco wrapped under tension.

Contrary to the prior art approaches, which generally attempt to minimize moistening of the tobacco and/or entail physically striking the cigarette, the present process of the invention requires moisture saturation of the cigarette paper wrapper, followed by the impact of steam under pressure on the wet cigarette. It is believed that an increased vapor pressure within the cigarette body occurs, caused by vaporizing of moisture which has permeated the paper wrapper. If the temperature of the cigarette body is high enough to melt the glue seam, the increased internal pressure will force open the weakened glue seam. If the glue seam does not open because it is insufficiently weakened, the tobacco rod is expelled from the open end or ends of the wrapper upon impact of the steam. This action may be a result of an increased vapor pressure within the cigarette body, caused by vaporization of moisture carried through the paper wrapper. The advantage of the process of the invention resides in the reclaimed tobacco, which unexpectedly exhibits minimal reduction in tobacco particle size. The long strands of the tobacco are generally reclaimed intact. Generally, the moisture content of the cigarettes is increased by about 10% by weight, consequently there is a need for subsequent drying steps. In addition, if the reject cigarette includes a filter component, the filter structure may be separated intact. This is particularly advantageous in reclaiming tobacco from cigarettes having multiple or pocket filters in which a portion of a filter is comprised of a granular material, such as charcoal. Such granular material would be admixed with the tobacco during reclaiming if the integrity of the filter structure was destroyed. This is, of course, an undesirable contamination of the tobacco. The invention, however, is broadly applicable to the reclaiming of tobacco from all types of cigarettes, whether filtered or unfiltered.

SUMMARY OF THE INVENTION

The invention comprises a method for reclaiming tobacco from cigarettes, which comprises;

saturating the cigarette paper wrapper with hot water;

impacting the wet cigarette body with steam, whereby the tobacco separates from the cigarette paper wrapper;

drying the separated cigarette; and separating the tobacco from the cigarette residues.

The invention also comprises apparatus for carrying out the method of the invention.

The method and apparatus of the invention is particularly advantageous for preparing, separating and reclaiming tobacco from filter tip cigarettes and is particularly useful for separating tobacco from filter tip cigarettes in which the filter includes granular additives.

DETAILED DESCRIPTION OF THE PREFERRED EMBODIMENT OF THE INVENTION

Figure 1:
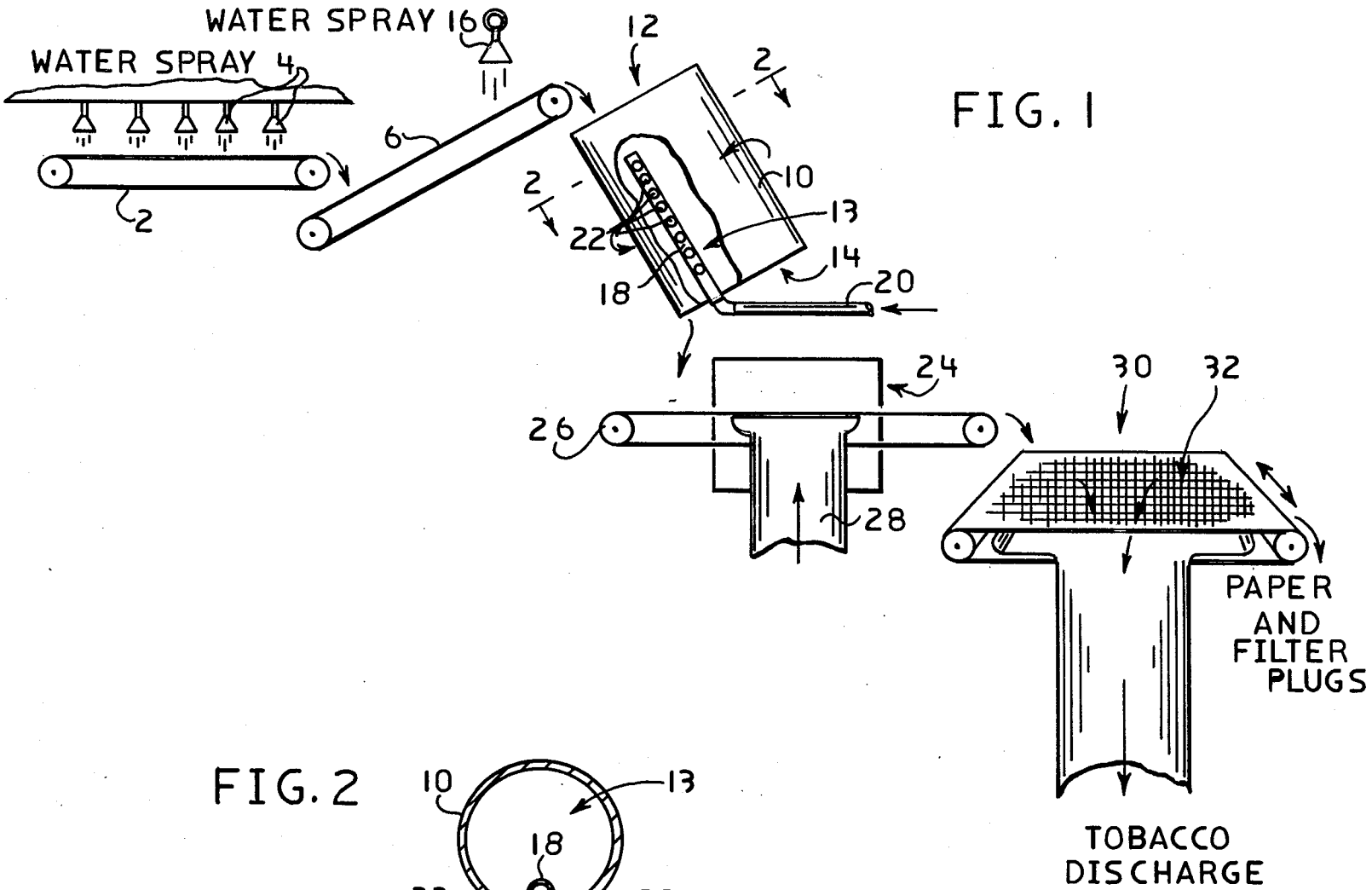
FIG. 1 is a schematic flow diagram illustrating a preferred embodiment process of the invention.
Figure 2:
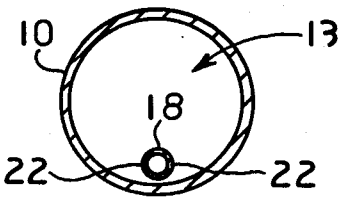
FIG. 2 is a view along lines 2—2 of FIG. 1.

The method of the invention may be carried out by first saturating the cigarette covering with hot water. This may be accomplished by spraying the cigarette body with hot water. This is preferably achieved in a continuous manner by passing cigarettes to be reclaimed into a first treatment zone where they are treated with hot water, preferably at a temperature sufficient to soften the adhesive forming the glue seam of the wrapper. The water treatment should be sufficient to saturate the cigarette paper wrapper.

In the preferred process of the invention, following hot water treatment in the first zone, the cigarettes may be conveyed continuously to a second treatment zone in which they are subjected to the impact of steam. This steam treatment causes an abrupt increase in the vapor pressure within the tobacco portion of the cigarettes as previously described, due to the high moisture content therein. The wrapper is thus forced to open along its seam or alternatively the tobacco rod is forced through the open end or ends of the cigarette. It has been found that at high moisture and temperature of the wrapper, following the hot water and steam treatment, one of two situations will occur, depending on the type of adhesive and its bond strength. That is, (a) The wrapper will flash dry and burst open at the glue line freeing the tobacco column, or (b) The wrapper will flash dry but remain intact while the tobacco column is expelled.

Following steam treatment in the second zone, the ruptured cigarettes are dried, preferably by passing them to a drying zone. The open cigarettes and the components thereof are preferably dried to their pre-process state of moisture content but at least sufficiently to facilitate separation of the tobacco from cigarette paper and other residues.

The dry tobacco may then be separated, employing any conventional means for separation such as a vibrating screen which segregates tobacco from the remainder of the cigarette. Alternatively, the drying and separation steps may be practiced simultaneously or the tobacco may be separated prior to drying.

Considering the preferred process of the invention in greater detail, the preferred minimum temperature of the water used in the aforementioned first treatment zone will depend upon the type of adhesive used to form the glue seam. In any event, the temperature selected will advantageously be sufficient to soften the adhesive, thus weakening the seam to facilitate its separation on the action of the increased internal vapor pressure resulting from the subsequent steam treatment. Advantageously, the heat transmitted to the adhesive seam is maintained in the cigarette body until the cigarettes are steamed, to maintain the adhesive in a softened condition. By way of example, the hot water temperature used with cigarettes having a glue seam formed with starch adhesive should be at least 170° F., while cigarettes formed using a polyvinyl alcohol adhesive requires a temperature of at least 190° F. The upper limit of the water temperature is about 210° F. The higher temperatures are advantageous. If lower temperatures are employed, the tobacco rod will be propelled out of the intact wrapper, effecting separation of tobacco from wrapper and filter without rupture of the glue seam.

Cigarettes received for reclaiming will normally have a moisture content of about 12 to 14%. The hot water treatment within the aforementioned first treatment zone will generally not significantly increase this moisture content but will saturate the paper wrapper component.

Within the aforementioned second treatment zone the moistened cigarettes are subjected to the physical impact of steam, which may be normal, i.e.; 212° F. or superheated steam. The wet cigarettes are preferably agitated by the impact of the steam and the manner of heating the wet cigarettes to assist seam opening. When steam is employed to facilitate rupture of the cigarette, rupture of the seam or expulsion of the tobacco rod generally occurs within a period of less than about 60 seconds. Tobacco moisture will have elevated to about 28%. Paper is dried sufficiently to recover its normal tensile strength through flash drying. At the end of this period, steaming may be terminated.

Separation or classification of the tobacco from the remainder of the cigarette material may be effected prior to, during or subsequent to drying of the tobacco to a desired moisture content. Preferably, however, the tobacco is separated subsequent to or simultaneously with the drying operation since there is less of a tendency for the dry tobacco particles to adhere to a dry paper wrapper residue. Several conventional techniques and apparatus suitable for drying and separating the tobacco will be readily apparent to those skilled in the art. Generally, drying with hot air and separation with a vibrating screen has been found to be quite satisfactory.

Referring now to the drawing of FIG. 1, it is seen that the preferred apparatus for carrying out the method of the invention is comprised of an inclined, rotatable, cylinder 10 having an opening 12 at its upper end for receiving cigarettes to be reclaimed from conveyor 6 and a discharge opening 14 through which cigarettes are discharged following treatment within treatment 10. The cylinder body is closed on its sides and the open ends 12, 14 are enclosed as much as possible to retain heat within the treatment zone 13. The cylinder 10 is mounted in any conventional manner for rotation as shown by the arrows in FIG. 1. Rotation is accomplished by a motor or drive means (not shown in FIG. 1).

A water spray 4 communicating with a hot water supply source (not shown) is positioned over a conveyor 2 which defines a first treatment zone. Discharge of hot water from spray 4 into the first treatment zone saturates the paper wrappers of cigarettes carried toward conveyor 6. Conveyor 6 transports the wet cigarettes to the open end 12 of cylinder 10.

As also shown in FIG. 1, the water spray 16 may be used as an alternate wetting position to spray 4 or may supplement spray 4. Generally, the closer in the point for administration of hot water to the cylinder 10, the better the maintenance of high temperature in the adhesive zone of the wetted cigarette.

A steam discharge pipe 20, communicating with a steam supply source (not shown), is positioned axially within the cylinder 10 in a second treatment zone 13. Steam is discharged into the second treatment zone of cylinder 10 under pressure from pipe 18 through multiple discharge ports or orifices 22.

The high pressure steam ejected through ports 22 causes turbulence within the treatment zone 13 and impacts upon the cigarettes disposed therein. This impact tosses the cigarettes and physically strikes them with steam and against one another. This impact and the high temperature precipitated by the steam ruptures the cigarette as described previously. The rotation of the cylinder 10 also contributes to impacting of wet cigarettes against one another to assist in rupturing the cigarettes.

The ruptured cigarettes together with their components are passed through the open end 14 of cylinder 10 to a dryer means.

A dryer means, generally designated 24, may be positioned to receive the wet and ruptured cigarette material discharged from opening 14. A preferred dryer means 24 is a fluid bed dryer which comprises a perforated conveyor 26 to carry wet material along a given pathway and a hot air blower 28 positioned to direct hot air forcibly through material being transported by conveyor 26. A rotary, or other type tobacco dryer may also be advantageously employed as the dryer means if so desired.

A classifier means, generally designated 30, may be positioned to receive dried material discharged from conveyor 26. Classifier means 30 may be, for example, a vibrating screen conveyor 32, preferably having a mesh size of from about 3 to about 4 mesh to permit tobacco to pass through while retaining the remainder of the cigarette components and materials (paper and filters) on its upper surface. After classifying, the separated tobacco and the cigarette residue materials may be separately directed to other areas for subsequent disposition, treatment, recycling and the like.

The following examples describe the manner and process of making and using the invention and set forth the best mode contemplated by the inventor of carrying out the invention but are not to be construed as limiting thereof.

Example 1

Tobacco is reclaimed from cigarettes containing filters of the type known as pocket filters (see U.S. Pat. No. 3,844,200), containing a granular material as part of the filter media. The glue seam of the cigarettes was formed using starch adhesive. These cigarettes are fed into opening 12 of cylinder 10 in the above described apparatus. Cylinder 10, which has a diameter of 18 inches, a length of 12 feet and an angle of inclination of 7° is rotated at a speed of 12 rpm to achieve a throughput of 500 lbs. per hour of rejected cigarettes.

As the cigarettes enter the first treatment zone under sprays 4 they are sprayed with hot water (at a temperature of 170° F.) to soften the adhesive and saturate the paper wrapper. The wet cigarettes delivered to cylinder 10 then continue to move through cylinder 10 by the force of gravity to the second treatment zone 13 where they are subjected to steam having a temperature of approximately 212° F. The steam is delivered under pressure. Under the agitation of the impact of the steam and rotation of cylinder 10, the glue seams on some of the cigarette wrappers open whereas on others the cigarette wrapper seams do not open, but, the tobacco rod is expelled from the open end of the cigarette body.

The ruptured cigarettes are then discharged from opening 14 onto conveyor 26. The tobacco and cigarette residues (filters, paper, etc.) are then dried in a fluid bed dryer with hot air at a temperature of about 200° F. The tobacco, after drying, is found to have a moisture content of approximately 14% by weight. The tobacco is then separated from the remainder of the cigarette residue on vibrating screen 32. The filters are recovered intact and unbroken. Upon classification, the separated tobacco shows that 19.15% of the tobacco is of a particle size retained on a plus ⅛th screen and 32.31% on a minus 1/16th screen. In a second run, 15.20% of the tobacco is of a particle size retained on a plus ⅛th screen and 47.10% on a minus 1/16th screen. By contrast, when tobacco was reclaimed using current state of the art methods similar to the teachings of U.S. Pat. No. 3,577,999 only 5.85% of the tobacco was retained on a ⅛th screen and 50.56% passed through a 1/16th screen.

For purposes of comparison, it is noted that the starting tobacco material (in cigarettes) upon classification 23.13% was retained on a ⅛th screen and 23.84% passed through a 1/16th screen.

From the above it is clearly seen that the tobacco reclaimed by this new method suffered minimal reduction in particle size compared to the conventional state of the art.

Example 2

The procedure of Example 1, supra., is repeated except that the rejected cigarettes were formed using polyvinyl alcohol as the adhesive and the hot water temperature was at 190° F. Similar results were obtained in the separated tobacco except that there appeared to be a higher percentage of rupturing by expulsion of the tobacco rod from the open end of the reject cigarette.

Figure 3:
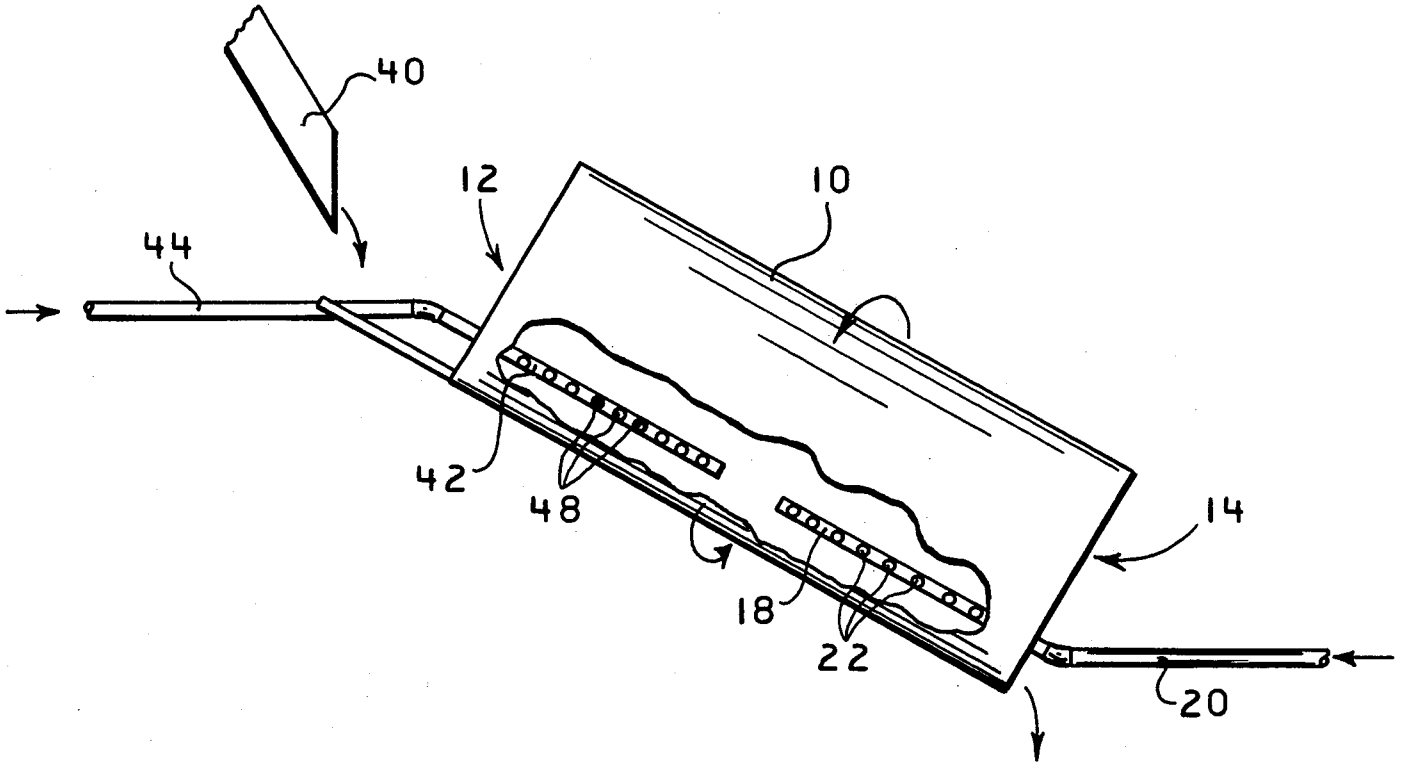
FIG. 3 is an isometric view, partly cut away, of an alternate component in the apparatus of the invention shown in FIG. 1.

Those skilled in the art will appreciate that many modifications may be made to the above described preferred embodiments of the invention without departing from the spirit and the scope of the invention. For example, referring now to FIG. 3, one may observe an alternate embodiment arrangement apparatus of the invention. As shown in FIG. 3, the first and second treatment zones are incorporated within the interior of cylinder 10. More specifically, the steam pipe 18 with steam portals 22 are in the lower end of cylinder 10 adjacent to the lower opening 14. Within cylinder 10 and adjacent to the upper opening end 12 there is a hot water pipe 44 connected to a hot water source (not shown in FIG. 3) and which delivers hot water to pipe 42 within the body of cylinder 10. The hot water is dispensed through portals 48. Reject cigarettes are delivered by chute 40 into the open end of the rotating cylinder 10 so that they are first wetted by hot water in the upper first treatment zone of cylinder 10 and are carried by gravity into the second treatment zone where they are impacted with steam dispensed by the portals 22.

The cigarettes are moistened and ruptured within the cylinder 10 shown in FIG. 3 and the ruptured cigarette materials are then ejected through the lower open end 14 to be received within a dryer means 24 as previously shown in FIG. 1. After drying, the dry residues are delivered to a vibrating screen such as that shown in FIG. 1 (vibrating screen 30).

What is claimed:

1. A method for reclaiming tobacco from cigarettes having a cigarette body surrounded by a cigarette paper wrapper, which comprises;

saturating the cigarette paper wrapper with hot water;

impacting and agitating simultaneously therewith the wet cigarette body with steam, whereby the tobacco separates from the cigarette paper wrapper;

drying the separated cigarette; and separating the tobacco from the cigarette residues.

2. The method of claim 1 wherein said saturating and impacting is carried out with simultaneous agitation.

3. The method of claim 1 wherein said cigarettes are heated.

4. The method of claim 1 wherein said cigarettes are filter tipped.

5. The method of claim 1 wherein said cigarettes are tipped with filters containing granular material.

6. A continuous method of reclaiming tobacco from cigarettes having a cigarette body of tobacco surrounded by a cigarette wrapper, which comprises;

passing the cigarettes into a first treatment zone;

treating the cigarettes in said first zone with hot water at a temperature sufficient to soften the adhesive forming the glue seam on the wrapper of said cigarettes;

passing the treated cigarettes into a second treatment zone;

impacting and agitating simultaneously therewith the cigarettes in the second treatment zone with steam, said impacting and agitating with steam being sufficient to cause an abrupt increase in the vapor pressure within the tobacco portion of the cigarette, whereby the tobacco separates from the wrapper;

passing the steamed cigarettes to a dryer;

drying the steamed cigarettes until the tobacco component is separable from the paper wrapper component of the cigarettes; and separating the dried tobacco from the cigarette residues.

7. The method of claim 6 wherein upon steaming the glue seam opens.

8. The method of claim 6 wherein upon steaming tobacco is expelled from an open end of its cigarette.

9. The method of claim 6 wherein separating is on a vibrating screen.

10. Apparatus for reclaiming tobacco from cigarettes which comprises;

a rotatable cylinder having a first open end and a second open end and a bore communicating between the ends;

means of delivering steam within said bore;

means for rotating said cylinder about its lengthwise axis;

means for delivering cigarettes into the first open end;

means for saturating the paper wrappers of said cigarettes with hot water adjacent said first open end;

said cylinder being positioned at an angle inclined to the horizontal so that cigarettes delivered at the first open end will be carried by gravity out of the second open end;

dryer means positioned to receive cigarettes discharged from the second open end of the cylinder; and classifying means associated with the dryer means for separating the dried tobacco from the remaining components of the cigarettes.

11. The apparatus of claim 10 wherein said means of delivering steam is a steam pipe having a plurality of portals along its length in the second zone.

12. The apparatus of claim 10 wherein said means for delivering cigarettes is a chute.

13. The apparatus of claim 10 wherein said means for delivering cigarettes is a conveyor.

14. The apparatus of claim 10 wherein said cylinder has an angle of inclination of 7 degrees.

15. The apparatus of claim 10 wherein the dryer means comprises a fluid bed air heated dryer.

16. The apparatus of claim 10 wherein said classifying means is a vibrating screen.

17. The apparatus of claim 10 wherein said means for saturating comprises a hot water spray associated with said means for delivering.

18. The apparatus of claim 10 wherein said means for saturating comprises a hot water spray located within the cylinder adjacent the first open end.

* * * * *